US005143395A

United States Patent [19]

Mayr

[11] Patent Number: 5,143,395

[45] Date of Patent: Sep. 1, 1992

[54] SKI

[75] Inventor: Bernhard Mayr, Hard, Austria

[73] Assignee: Head Sportgerate Gesellschaft m.b.H. & Co. OHG, Wuhrkopfweg, Austria

[21] Appl. No.: 680,144

[22] Filed: Apr. 3, 1991

[30] Foreign Application Priority Data

Apr. 5, 1990 [AT] Austria ..... 820/90
Sep. 17, 1990 [AT] Austria ..... 1888/90

[51] Int. Cl.[5] ..... A63C 5/075

[52] U.S. Cl. ..... 280/602; 280/607; 280/617; 280/618; 280/633

[58] Field of Search ..... 280/602, 607, 610, 609, 280/617, 618, 601, 634, 633

[56] References Cited

U.S. PATENT DOCUMENTS 3,260,532 7/1966 Heuvel ..... 280/11.13
3,567,237 10/1968 Miller, III ..... 280/610
4,519,625 5/1985 Luitz et al. ..... 280/617

FOREIGN PATENT DOCUMENTS 389643 6/1989 Austria .
37145 7/1989 Austria .
2259375 6/1974 Fed. Rep. of Germany .
2634748 2/1978 Fed. Rep. of Germany .
3315638 12/1983 Fed. Rep. of Germany .
143563 12/1953 Sweden ..... 280/607
WO83/03360 10/1983 World Int. Prop. O. .

*Primary Examiner*—Eric D. Culbreth
*Attorney, Agent, or Firm*—Nixon & Vanderhye

[57] ABSTRACT

In a ski that has integrated elements for the attachment for components of the binding system, the ski is bonded rigidly to an essentially plate-shaped carrier body that extends in the longitudinal direction of the ski, in an area that lies between the ends that face in the longitudinal direction of the ski. Outside the area that is bonded rigidly to the ski, the carrier body incorporates guide rails or grooves that extend in the longitudinal direction of the ski and are used for the attachment of the components of the bindig system, and the ends of the carrier body that face in the longitudinal direction of the ski are arranged at a distance from the upper side of the upper chord of the ski. It is preferred that outside the area that is bonded rigidly to the ski the carrier body is bonded rigidly to the ski or to the upper chord of the ski through interposed damping material.

19 Claims, 8 Drawing Sheets

SKI

Figure 1:
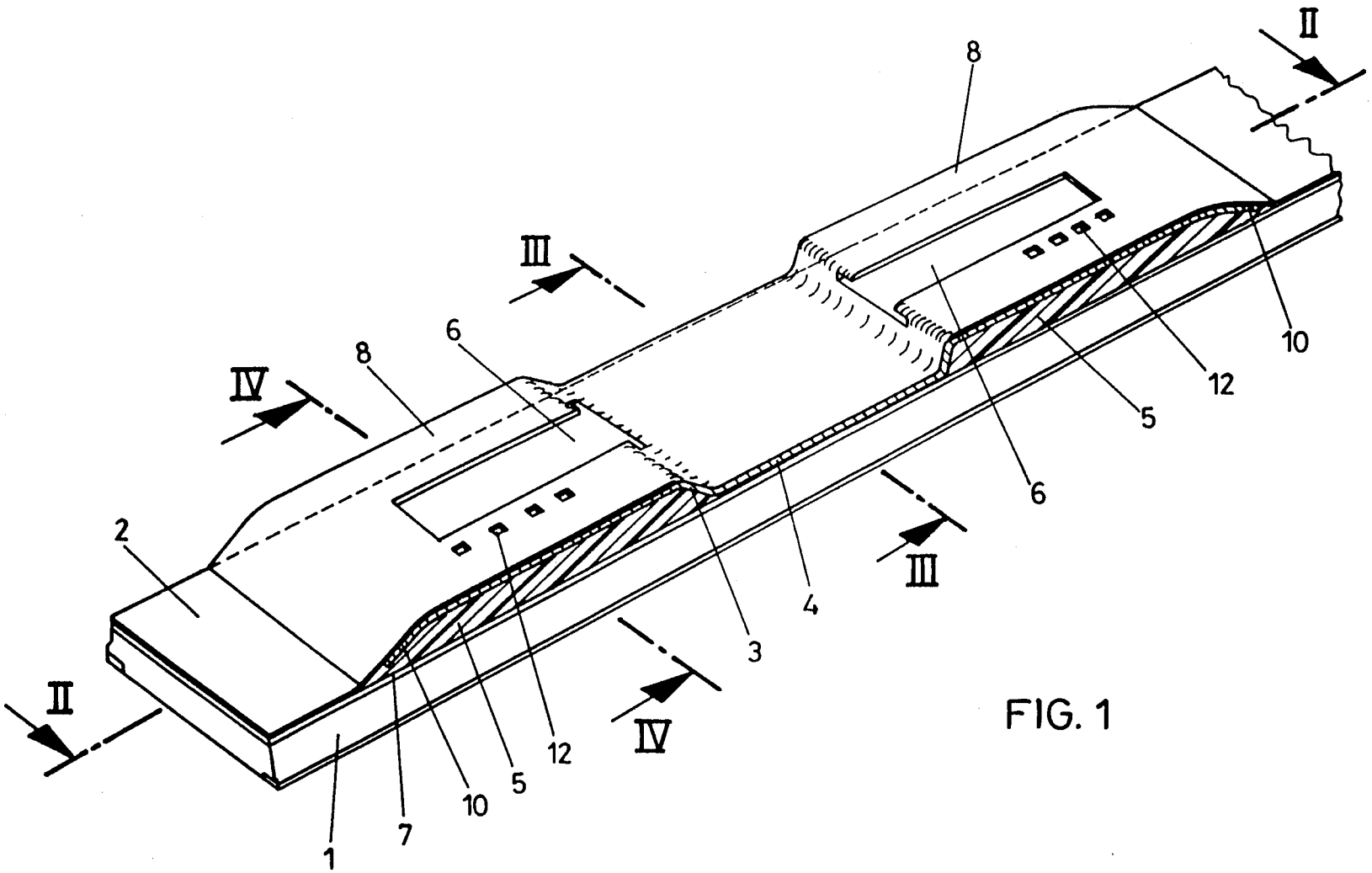

The present invention relates to a ski with integrated elements for attaching the components of the binding system.

Integrated elements for the attachment of components of the binding system, in the form of threaded sleeves let into the ski, have already been proposed. However, prefabricated anchor points or anchor beds for components of the binding system are not suitable for keeping the components of the binding system at a precisely defined distance from each other once they have been attached to the ski if said ski flexes during use. The increase or decrease of the effective distance between the front component of the binding system and the rear component of said binding system that can be measured when the ski flexes leads to a distortion of the release forces and can also lead to unintentional release of the bindings. For this reason, it has already been proposed to protect the components of the binding system from such flexural forces in that the binding was installed on a plate that is separate from the ski, said plate being installed on the ski in an appropriate manner so as to be displaceable in the longitudinal direction. In designs of this kind it is, for example, known, that a plate that bears the components of the binding system can be articulated so as to pivot on the ski and to permit a measure of longitudinal tolerance by attaching a plate of this kind in slots or by means of overlapping claws. As a rule, plates of this kind that are separate from the ski do not perform any supporting function in the structure of the ski, this being done in order not to diminish longitudinal equalization, and for this reason they are not suitable of affecting, in particular increasing, the torsional stiffness of the ski in the middle area in which the binding is attached.

It is also known that the components of the binding system can be joined to the surface of the ski with elastically deformable elements being interposed between the components of the binding system and the surface of the ski. To this end, EP-B1 104 185 describes a plate that supports a binding element that is connected rigidly to the ski at one end that points in the longitudinal direction of the ski and at the other, unattached, end, is secured to the ski through slots, with damping elements being installed between the plate and the ski. The attachment in such a manner at at least one end so as to provide for longitudinal movement is necessary in order to prevent the screw connections shearing off when the ski flexes. In a design such as this, shocks that act on the components of the binding system, which are normally perpendicular to the surface of the ski, are insufficiently damped, so that complete decoupling of the release forces required for the binding from the shocks that act on the ski is not possible without further measures. This type of attachment for a plate modifies the flexural behavior of the ski. An attachment of this kind does not allow for any notable influence on the torsional properties in the area of the binding. In the case of sprung arrangements of binding elements, as is described, for example, in DE-OS2 634 748 a springboard that can pivot transversely to the longitudinal direction of the ski is used; using an arrangement of this kind makes it easier for the skier to change direction. Although the plate on which the components of the binding system are attached can be protected against the effects brought about when the ski flexes by using this sort of configuration, the attachment of sprung elements of this kind is relatively costly, and all in all there is no torsional stiffening in the area of the binding of the ski, no matter how this may be produced. In addition, plate-like elements that can be adjusted with regard to their inclination transversely to the longitudinal axis of the ski naturally have no effect on the torsional properties of the ski.

Thus, it is the object of the present invention to create a ski of the type described in the introduction hereto, said ski having integrated elements for the attachment of the components of the binding system, with which the torsional properties in the area of the binding can be influenced by adjustment and in which, at the same time, the release characteristics of a binding remain largely unaffected during varying degrees of flexing of the ski. In addition, in such a system, a further object of the present invention is to provide the possibility of connecting the components of the binding system with the integrated parts for the attachment of the components of the binding system in such a manner as to permit them to dampen shocks that act vertically on the surface of the ski. In order to solve this task, the ski according to the present invention is essentially such that the ski is connected rigidly to a carrier body that extends in the longitudinal direction of the ski, and which is essentially in the form of a plate, in an area of the carrier body that is between the ends that face in the longitudinal direction of the ski; in that the carrier body incorporates guide rails or grooves for attaching of the components of the binding system, these extending in the longitudinal direction of the ski beyond or outside the area that is connected rigidly with the ski; and in that the ends of the supporting body that face in the longitudinal direction of the ski are arranged at a distance from the upper side of the upper chord of the ski. Because of the fact that the attachment of a carrying body of this kind, which is essentially in the form of a plate, is rigid in an area of the supporting body that lies between the ends that face in the longitudinal direction of the ski, it is possible to achieve a defined stiffening of the ski against torsional forces in the area of the binding, and because of the fact that the areas that are outside this area of the supporting body that is connected rigidly to the ski are at a distance from the upper surface of the ski, these areas of the supporting body are not acted on directly by the bending forces, even when the ski flexes. The flexural behavior of a ski in the longitudinal direction of the ski is in no way affected by a configuration of this kind, and the plate-like supporting body can be connected to the ski in an extremely safe and simple manner, and can, in particular, be integrated into the ski. Because of the attachment of the supporting body in an essentially central position, the supporting body itself can be decoupled from forces that act on the ski whereas, on the other hand, the release forces that act on the components of the binding system do not reach directly into the body of the ski. The decoupling of the binding from the ski, which can be achieved in this manner, makes it possible to define the desired release forces of the binding more precisely, and excessive safety reserves for the release of a binding and, thus, in many instances, premature release of the binding, can be avoided.

As has already been discussed in the introduction hereto, this kind of attachment of the integrated elements for the attachment of components of the binding system to the ski itself also permits the attachment of components of the binding system in a manner such as to permit the damping of shocks that act vertically on the surface of the ski. A certain degree of damping is already provided by the properties of the material used in the essentially plate-like carrier body, although here the damping effect would result from the oscillation of the unattached end of the carrier body, which would once again lead to a change in the effective distance between the components of the binding system along the damping travel. In order to keep the damping travel necessary for the proper absorption of vertical blows as small as possible and, at the same time, ensure the desired decoupling of the ski and the components of the binding system, it is advantageous that the configuration be such that the carrier body is connected to the ski or the upper chord of the ski, respectively, outside the area that is connected rigidly with the ski, and through interposed damping material. A consequence of this kind of arrangement of the damping material is that the elasticity, and thus the bending behaviour, of the ski in the longitudinal direction of the ski is in no way restricted, and attachment in the middle area ensures the desired stiffening against torsional forces. At the same time, this ensures the proper damping of vertical shocks and as a result of the attachment of the carrier body in the middle area of the carrier body it ensures a safe and to the greatest possible extent indestructible connection between the carrier body and the ski. In order to permit the fixing of the components of the binding system at the desired distance from each other, it is advantageous that the configuration be such that within the area of the guide rails or guide grooves the carrier body incorporate projections or recesses for locking the components of the binding system against displacement in the longitudinal direction of the ski.

The configuration according to the present invention, as in other preferred developments, can be such that the carrier body is arranged beneath the surface covering layer, and in particular beneath a decorative surface foil. In this way, it has been possible to achieve an integration of the carrier body and of the damping element in the ski design directly during production, which retains the desired elasticity in the longitudinal direction, and which simultaneously ensures a high level of protection against desstruction.

In order to permit adjustment of the torsional characteristics of a ski whilst at the same time retaining the flexural elasticity in the longitudinal direction of the ski to the desired extent, the carrier body can advantageously incorporate profiles that extend transversely to the longitudinal direction of the ski, in which connection the configuration is particularly advantageous in that in the middle area the carrier body incorporates a recess that corresponds essentially to the thickness of the damping material and is bonded rigidly to the ski in this recessed area. Such a lowered section in the middle area permits easy connection of the carrier body to the upper chord of the ski, in which connection the damping material can be recessed, at least partially, into the surface of the ski. At the same time, this kind of configuration is particularly well-suited for the arrangement of a guide groove for the installation of components of the binding system, in which connection the components of the binding system can be slid into position into the guide groove in the longitudinal direction of the ski, starting from the recessed area of the carrier body. Such a configuration of the carrier body increases the torsional stiffness because of the rounded sections in the area of the profile recess, in which connection the torsional properties can be varied to a very great extend because of the shape and size of the transversely arranged profilings. In this kind of configuration, with a depressed central area of the carrier body that is attached to the upper chord of the ski the design can also be such that the depressed area of the carrier body is filled with an appropriately pressure resistant filler, when it is advantageous that the rigid connection of the carrier body to the upper chord of the ski is in the form of an adhesive bond. In this case, it is advantageous that a guide rail to accommodate the components of the binding system be used. In addition to a rigid adhesive bond, the midsection of the carrier body can be bolted to the ski, and in particular to the upper chord of the ski, in which connection this kind of screw connection does not have to absorb any shearing forces when the ski flexes.

An undivided configuration of the surface, with simultaneous and additional security of the damping elements, is ensured in that the carrier body is arranged beneath the surface covering layer, in which connection it is advantageous that the configuration be such that the carrier body be arranged in a recess in the upper side of the ski flush with the surface covering layer or foil. In order to prevent the destruction of the surface covering layer when a ski that incorporates a configuration of this kind flexes, and in order that the flexibility of the ski in the longitudinal direction is in no way restricted, it is advantageous that the surface foil be separated or cut through in front of and behind the carrier body, this being done transversely to the longitudinal direction of the ski, it being advantageous that the transition from the undamped areas of the ski to the area of the carrier body be configured so as to be flat and without any pronounced edges, in order to avoid excessive stress at this point. To this end, it is advantageous that the configuration be such that the unattached ends of the carrier body be so configured as to form an acute angle with the ski.

It is advantageous to use carrier bodies of metal, in particular of aluminum, when, in order to improve the adhesive bond and to permit simpler machining, the configuration can be such that the carrier body is connected rigidly to the upper chord of the ski through at least one interposed layer of glass fibre reinforced plastic. In addition to connection of the carrier body to the upper chord through an interposed glass fibre reinforced plastic of this kind, the whole inner surface of the carrier body can incorporate a layer of glass fibre reinforced plastic so that, as a consequence, there is also simple adhesion to the damping material.

In order to achieve a high degree of variability with regard to torsional stability or the torsional characteristics of the ski, respectively, using simple means, it is advantageous that the configuration be such that damping elements of different hardness or stiffness be arranged adjacent to each other and transverse to the longitudinal direction of the ski, in which connection, in these cases, the damping elements that are arranged adjacent to each other in the longitudinal direction of the ski can be welded or cemented in a particularly advantageous manner to the layer of glass fibre reinforced plastic on the inner side of the carrier body.

A material with a Shore hardness of Shore A 30–90 has been found to be particularly suitable for the camping element, the thickness of the damping elements being advantageously between two and twelve mm.

In order to provide for more extensive adjustment of the flexibility of the carrier body and of the damping material it is preferred that the configuration be such that the damping material incorporates recesses, in particular drillings, that extend essentially transversely to the longitudinal direction of the ski, when these recesses can either remain empty or else elements, in particularly rods, of different hardnesses and flexibility characteristics can be inserted into the recesses.

The configuration according to the present invention permits a full range of elastic motion of the ski without restriction by the damping element and results in a rigid attachment of the carrier body and of the damping element, which cannot be detached during use, in which connection there is no danger of the carrier body or the damping element becoming loosened when the ski flexes vigorously. For reasons of stability, when skis are retrofitted with carrier bodies of this kind, for reasons of safety it is advantageous to use a screwed connection in addition to the rigid bonding that is used in the middle area, because a secure cemented joint cannot be ensured because of the problematic cleaning of the cemented surfaces. Only in the case of attachment that is effected during manufacture, during which the rigid cementing is effected directly on the upper chord of the ski is it possible to ensure a replicable and reliable bond.

It is possible to adjust the torsional characteristics by using different hardnesses in the damping elements that extend in the longitudinal direction of the ski, in which connection an additional possibility for varying the torsional stability lies in selection of the manner in which the carrier body is profiled. Glass fibre reinforced plastic on the inner side of such carrier bodies can, on the one hand, simplify good bonding, and on the other can assume the functions of reinforcing laminates, which can simultaneously increase torsional stability and reduce the danger of the bindings, which can be attached to damping elements of this sort, from tearing out. In addition, prefabricated anchoring points, such as, for example, threaded sleeves or the like, can be integrated into the carrier body for the attachment of the bindings.

The present invention will be described in great detail below on the basis of the embodiments shown in the drawings appended hereto. These drawings show the following.

Figure 2:
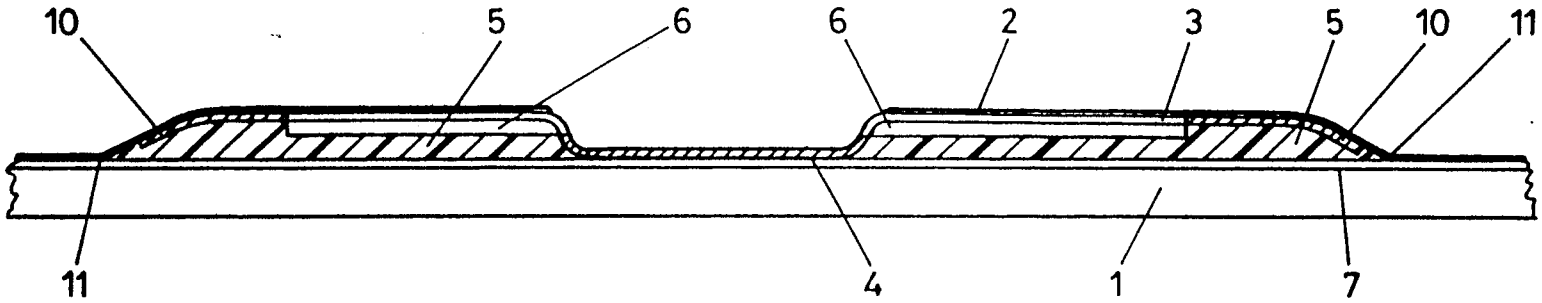
Figure 5:
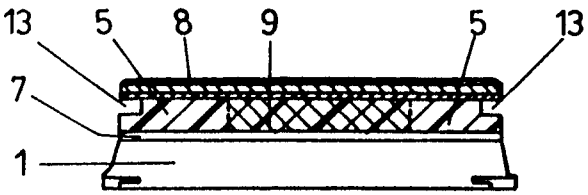
Figure 4:
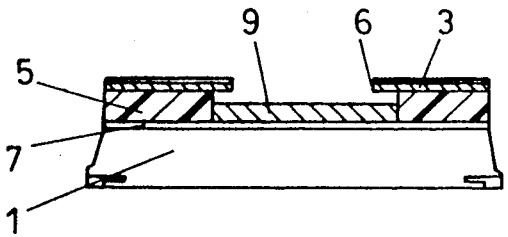
Figure 3:
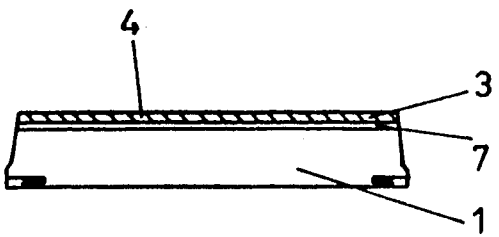
Figure 6:
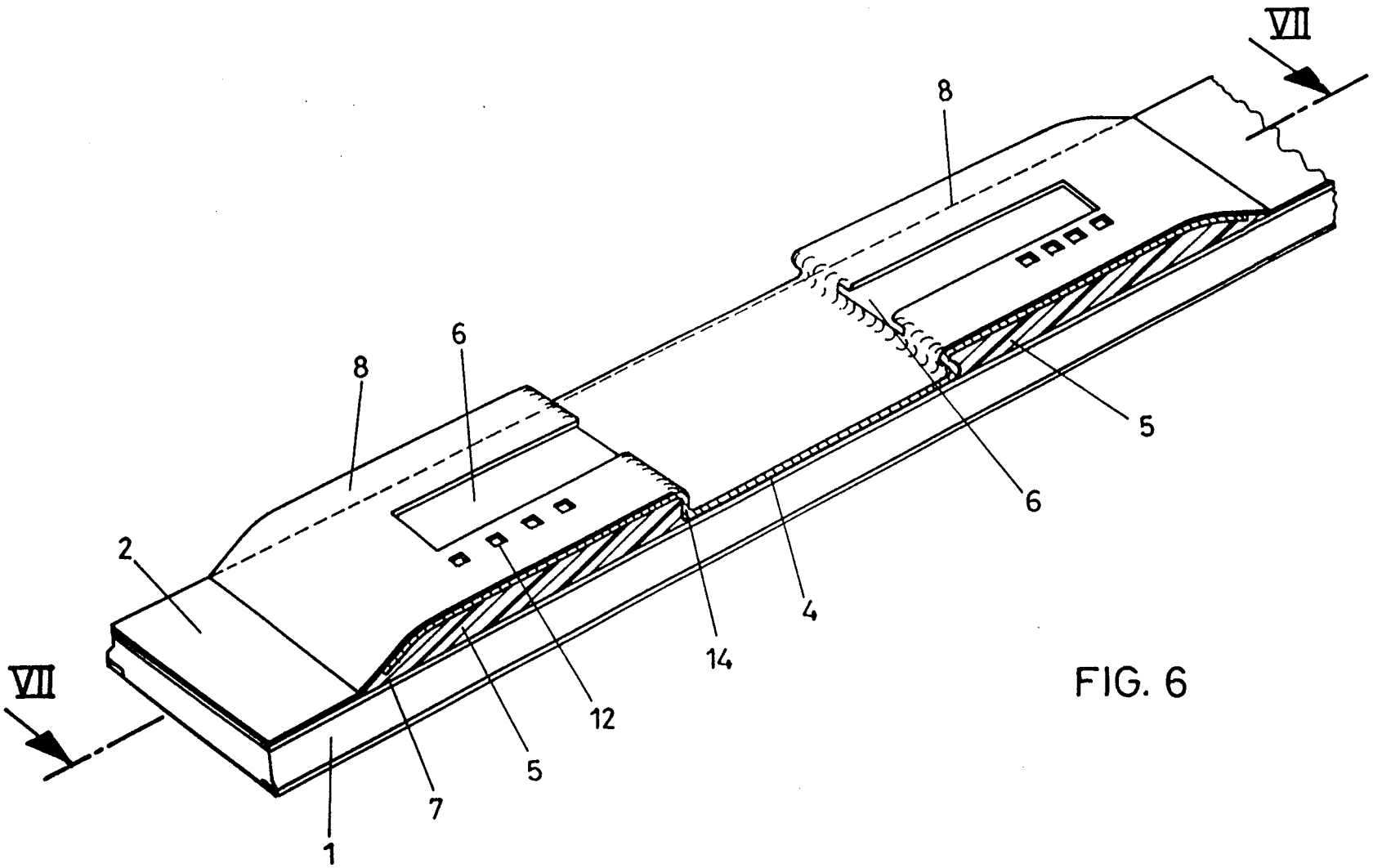
Figure 7:
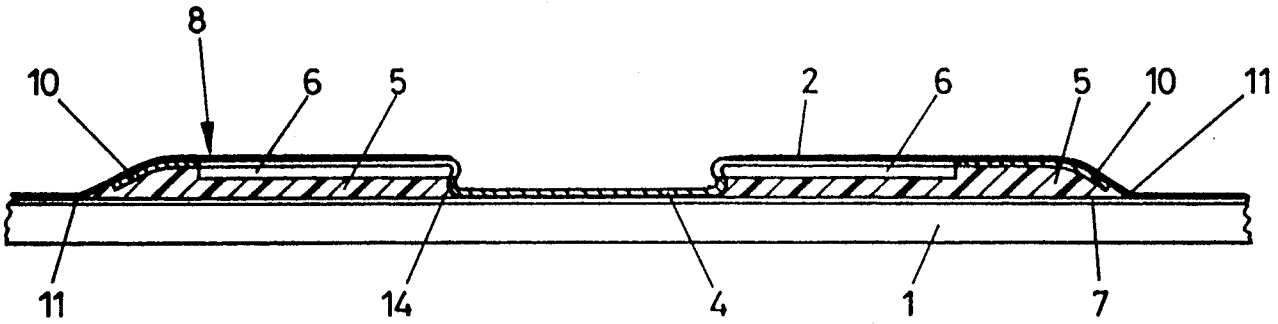
Figure 9:
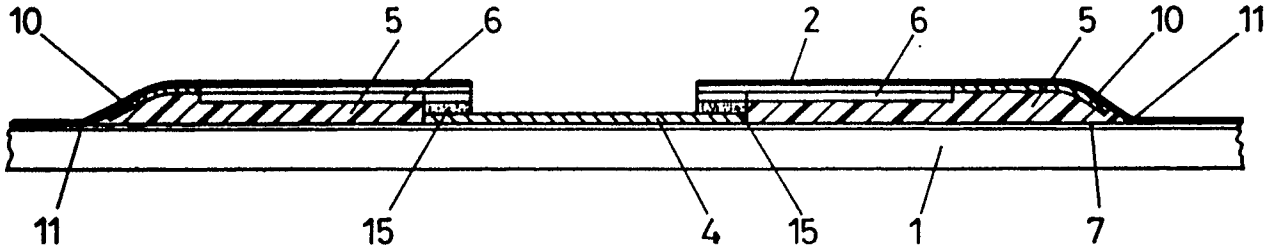
Figure 8:
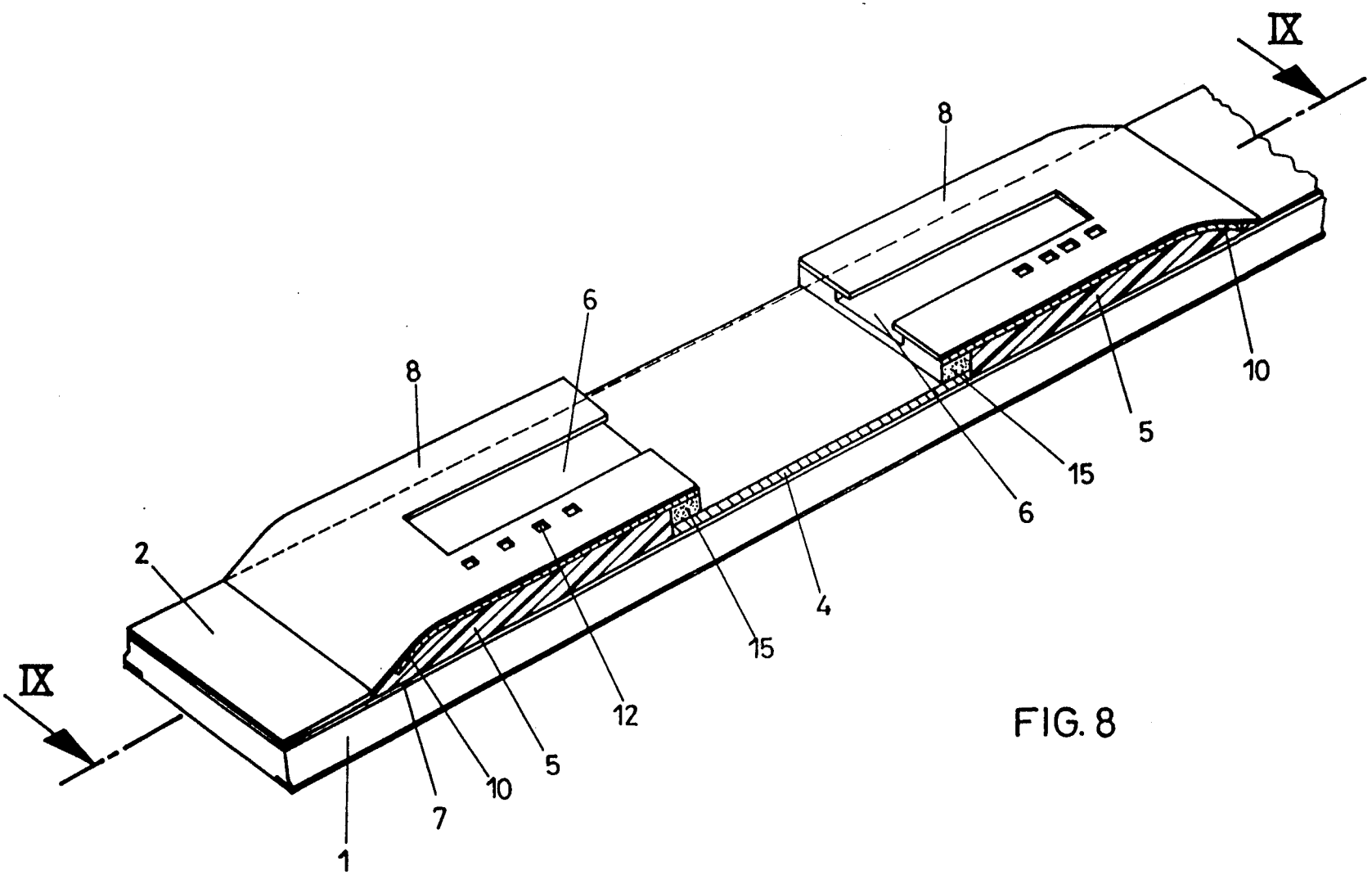
Figure 10:
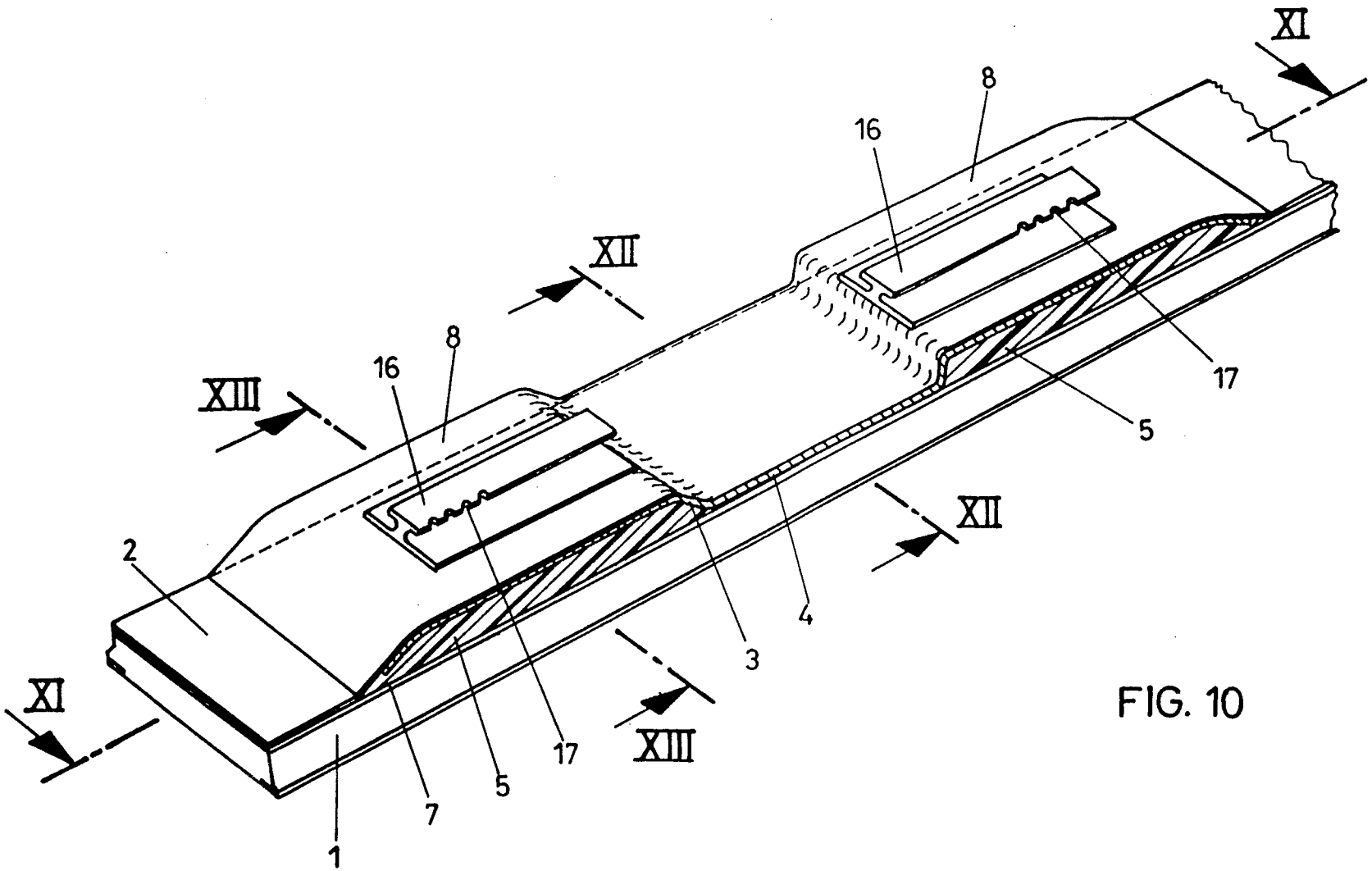
Figure 11:
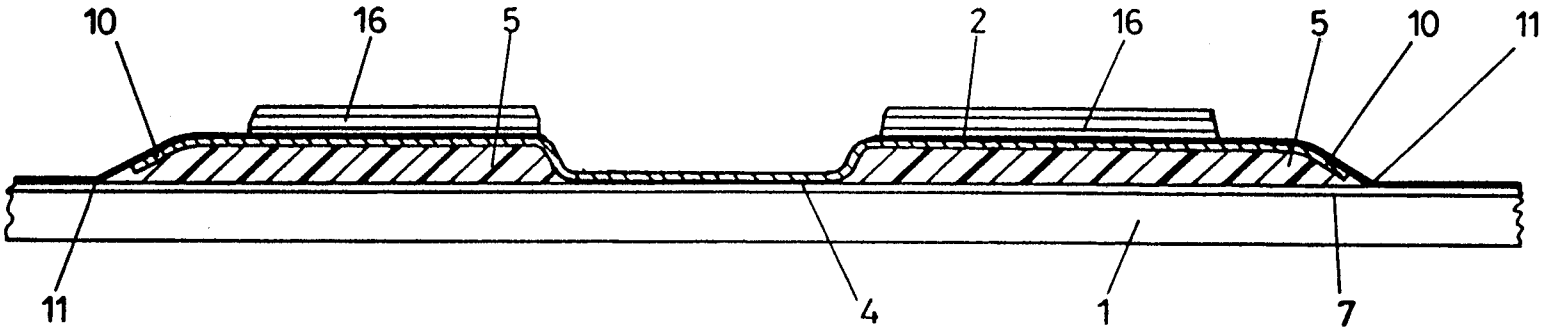
Figure 13:
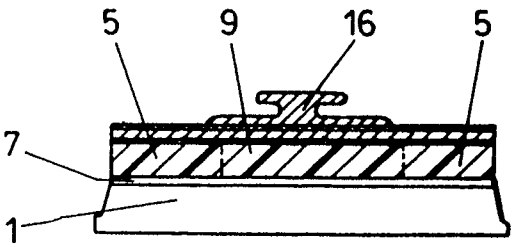
Figure 12:
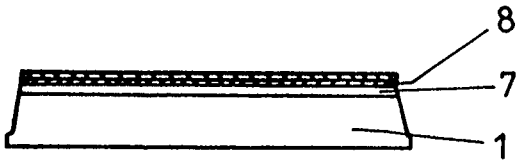
Figure 14:
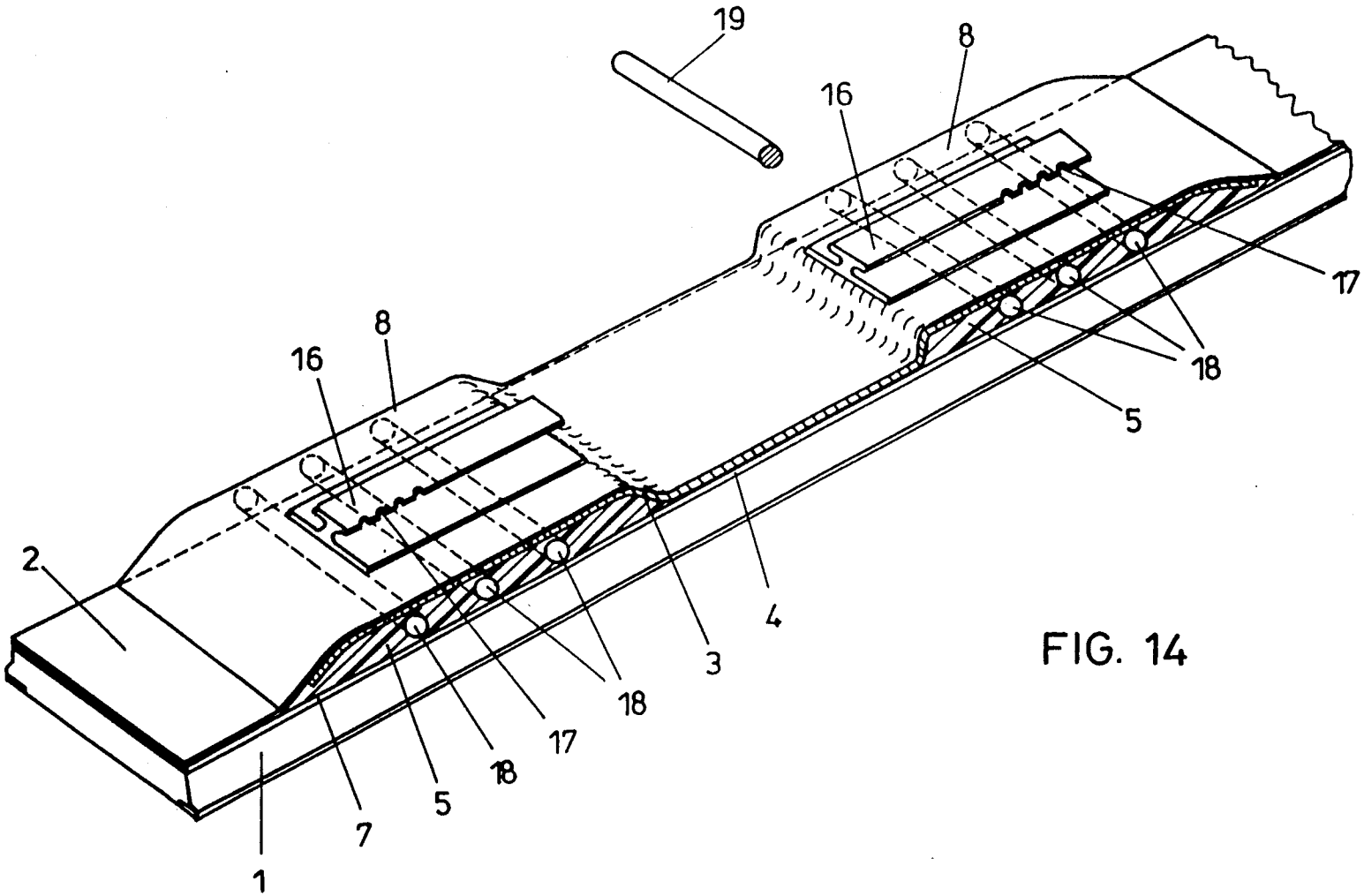

FIG. 1: A partial perspective view of a ski according to the present invention;

FIG. 2: A cross-section on the line II—II in FIG. 1;

FIG. 3: A cross-section on the line III—III in FIG. 1;

FIG. 4: A cross-section on the line IV—IV in FIG. 1;

FIG. 5: A cross-section through a modified embodiment in a view analogous to that shown in FIG. 3;

FIG. 6: A partial perspective view of a modified embodiment in a view analogous to that shown in FIG. 1;

FIG. 7: A cross-section on the line VII—VII in FIG. 6;

FIG. 8: A partial perspective view of another embodiment of a ski according to the present invention in a view analogous to that shown in FIG. 1 and FIG. 6;

FIG. 9: A cross-section on the line IX—IX in FIG. 8;

FIG. 10: An additional partial perspective view of a modified embodiment of a ski according to the present invention in a view analogous to that shown in FIGS. 1, 6, and 8;

FIG. 11: A cross-section on the line XI—XI in FIG. 10;

FIG. 12: A cross-section on the line XII—XII in FIG. 10 and FIG. 11;

FIG. 13: A cross section on the line XIII—XIII in FIGS. 10 and 11;

FIG. 14: An additional modified embodiment in a view analogous to that shown in FIG. 10, with recesses in the damping material that are used to adjust flexibility.

FIGS. 1 to 4 show a first embodiment of a ski 1, the upper side of which is covered by a surface covering layer, for example a decorative surface foil 2. In the area of a ski binding (not shown in greater detail herein) there is an essentially plate-shaped carrier body 3 that is used to accommodate components of the ski binding system and, if needs be, for damping shocks that act transversely to the longitudinal direction of the ski, this plate being, for example, of aluminum, and connected rigidly to the ski by cementing and, optionally, by additional screw connections. The ends of the carrier body 3 that face in the longitudinal direction of the ski and are adjacent to the middle area 4 which is connected rigidly to the ski 1, are arranged at a distance from the upper side of the upper chord 7 of the ski and join the ski through interposed damping material 5, in particular an elastomer damping material. In order to provide for the atachment of binding system components (not shown in greater detail herein) to the carrier body 3, there are guide grooves 6 which start from the depressed area 4 of the rigid connection of the carrier body 3 with the ski 1, and these extend over part of the areas 8 of the carrier body 3 that extend at a distance from the upper chord 7 of the ski. The depth of the depressed area 4 of the profile that forms the carrier body 3 corresponds essentially to the thickness of the damping material 5, and is greater than the depth of the guide grooves 6.

The bonding or the rigid connection of the carrier body 3 to the ski 1, and in particular with its upper chord 7, can be effected through an interposed layer of glass fibre reinforced plastic. Furthermore, in order to provide for the simple attachment of the damping material, a continuous layer of glass fibre reinforced plastic can be provided on that surface of the carrier body 3 that is proximate to the ski 1.

In order to provide additional control of the torsional characteristics of the ski 1 beyond that provided by the bonding of the middle section 4 of the carrier body 3, damping elements of various hardnesses can be arranged transversely to the longitudinal direction of the ski and adjacent to each other, as is indicated in FIG. 4 by the outside damping elements 5 and the inside damping elements 9.

In order that they do not affect the characteristics of the ski when it flexes, the unattached ends 10 of the carrier body 3 form an acute angle with the surface of the ski 1 or of its upper chord 7 and end, when the ski is not under load, at a small distance from the surface of the upper chord 7. In order to avoid damage or destruction of the surface covering layer 2 even when there is pronounced flexing, the surface covering layer is separated or out through immediately in front of and behind the carrying body, transversely to the longitudinal direction of the ski, as is shown diagrammatically at reference 11.

In addition to the guide groove 6, the areas 8 of the carrier body 3 incorporate recesses or projections 12 in the vicinity of the guide groove 6; these recesses or projections 12 are used to lock components of the binding system (not shown herein) in various positions.

In FIG. 5, in place of the guide groove 6 that is used to secure components of the binding system and which extends, in the middle of the carrier body 3 as viewed in the longitudinal direction of the ski, in the area of the outer edges of the areas 8 of the carrier body 3 there are grooves 13 that extend in the longitudinal direction and are used to accommodate components of the binding system.

In the configuration shown in FIGS. 6 and 7 there is a transitional area 14, which is of S-shaped cross-section, between the area 4 that is bonded rigidly to the upper chord of the ski or the ski, respectively and the areas 8 that are located at a distance from the upper chord of the ski; this S-shaped rounding is incorporated in order to provide greater elasticity.

In the configuration shown in FIGS. 8 and 9 the carrier body is a multi-part carrier body in which, once again, the middle area 4 is bonded rigidly to the ski 1 or to the upper chord 7 of the ski, respectively, and the areas 8 that are located at a distance from the surface of the ski or from the upper chord 7 of the ski are bonded in a sandwich-type bond with the area 4 of the carrier body 3 through interposed elements 15 that are of suitably stable material. The areas 8 of the carrier body 3 once again incorporate guide grooves 6 that are used to accommodate components of the binding system (not shown herein) and which extend once again in the longitudinal direction of the ski and extend over a part of the length of the areas 8.

In the configuration shown in FIGS. 10 to 13, in place of the guide grooves that extend in the longitudinal direction of the ski there are guide rails 16 onto which components of the binding system (not shown herein) can be slid. Once again, the guide grooves 16 incorporate recesses or projections 17 in order to lock the components of the binding system at various axial distances from each other.

In the configuration shown in FIGS. 10 to 13 with the guide rails 16 that are raised above the carrier body it is still possible to use the profiles for the carrier body 3 that are shown in FIG. 6 or FIG. 8.

In the configuration shown in FIG. 14 there are recesses or drillings 18 incorporated in the damping material 5, these extending essentially transversely to the longitudinal direction of the ski and resulting in an increase in the elasticity of the carrier body 3 and of the damping material 5, depending on the number and arrangement used. In order to set various hardness and flexibility properties of the damping material 5, rods 19 of appropriate cross-section can be introduced into the recesses or drillings 18, respectively when, by using rods having various material properties, it is possible to obtain a match to the desired flexibility behaviour of the damping material 5.

Because of the fact that the areas 8 of the essentially plate-shaped carrier body 3 that supports the guide groove 6 or the guide rail 16 run at a distance from the surface of the ski or from the upper chord 7 of the ski and even during flexing there is no direct contact of the areas 8 on the chord of the ski, it is possible to decouple the oscillatory behaviour of the ski and of the binding so that blows or shocks to the ski can be intercepted completely by the damping elements and not transmitted to the binding or to the skier's foot. In place of the rounded configuration of the carrier body 3 it is possible to provide a plate-shaped carrier body that is essentially flat, especially if guide rails are used, when once again this will be joined to the upper surface of the ski only in the middle area 4, whereas the areas 8 of the upper chord that are adjacent in the longitudinal direction of the ski can be configured so as to be lower than the upper chord in order to provide a space between the upper side of the upper chord or of the ski and the areas 8 of the carrier body 3 that are not connected to the ski. Because of the fact that, regardless of the flexing of the ski, there will always be a space between the areas 8 of the carrier body 3 and the upper side of the upper chord 7 or of the ski 1, there will always be a constant distance between the components of the binding system and there will be no change in the distance between the components of the binding system as a result of the ski flexing, which can cause the accidental release of the binding. The guide groove 6 or guide rails 16, respectively, are so configured that it is possible to slide ski binding jaws, rims, and braking elements onto or along the axis of the ski. The projections or recesses 12 that are provided for locking such elements entail the advantage that the binding and, optionally, the braking elements can be snapped into different positions in front of and behind the area 4 of the carrier body 3 that is bonded rigidly to the ski, according to the boot size that is accommodated and its position, with an equal distance between the locking elements 12, so that within a certain range the installation point for the components of the ski binding system can be varied relative to the ski. Simple installation, which does not involve the use of special tools, is made possible by simply sliding on or in the binding components and locking them onto the projections or in the recesses 12, since there is no need for drilling and subsequent bolting of the binding system components to the ski. When curved carrier bodies are used there is also the added advantage of a greater distance between the ski boot clip and, in particular, the sole of the ski boot from the lower edge of the ski and thus greater ground clearance, which is of particular advantage when the ski edges are used and short radius turns are made. Furthermore, the installation and removal of the components of the ski binding system by simply sliding them into position provides simple protection against theft and permits space-saving transportation of the skis by simply removing the bindings. Furthermore, within the depressed area 4 of the carrier body there is also room to incorporate various additional devices such as, for example, a lockable ski brake, lockable binding elements, an odometer, or electronic binding controls.

I claim:

1. A ski having a longitudinal direction, and ends, and a top chord, with integrated elements for the attachment of components of a binding system for the ski, wherein the ski is rigidly bonded to an essentially plate-shaped carrier body that extends in the longitudinal direction of the ski in an area of the carrier body that lies between the ends of the ski in the longitudinal direction of the ski; said carrier body incorporating guide elements for the attachment of components of the binding system, the guide elements extending in the longitudinal direction of the ski, outside the area that is rigidly bonded to the ski; and the ends of the carrier body in the longitudinal direction of the ski being arranged at a distance from an upper side of the top chord of the ski.

2. A ski as defined in claim 1, wherein the carrier body is connected to the ski top chord, through interposed damping material outside the area that is rigidly bonded to the ski.

3. A ski as defined in claim 2, wherein in the middle area the carrier body has a depressed area that corresponds essentially to the thickness of the damping material and is bonded rigidly to the ski in the depressed area.

4. A ski as defined in claim 2, wherein the damping material incorporates recesses that are essentially transverse to the longitudinal direction of the ski.

5. A ski as defined in claim 1, wherein, in the area of the guide elements, the carrier body incorporate retaining means for locking the elements of the binding system so 6. A ski as defined in claim 1, wherein the ends of the carrier body form an acute angle with the ski.

7. A ski as defined in claim 1, wherein the carrier body is rigidly connected to the tap chord of the ski through an interposed layer of glass fibre reinforced plastic.

8. A ski as defined in claim 1, wherein the carrier body is of aluminum.

9. A ski as defined in claim 1, wherein the carrier body incorporates at least one layer of glass fibre reinforced plastic on its inner side that is proximate to the ski.

10. A ski as defined in claim 1, wherein the carrier body is arranged in a recess in the upper side of the ski so as to be flush with a surface covering layer or foil.

11. A ski as defined in claim 1, wherein damping elements of various hardnesses or stiffness are arranged transversely to the longitudinal direction of the ski and adjacent to each other in the longitudinal direction of the ski.

12. A ski as defined in claim 11, wherein the damping elements that are used have a Shore hardness of thirty to ninety.

13. A ski as defined in claim 11 wherein the damping elements have a dimension of about 2–12 mm measured perpendicularly to the surface of the ski.

14. A ski as defined in claim 1, wherein the carrier body incorporates profilling that extends transversely to the longitudinal direction of the ski.

15. A ski as defined in claim 1, characterized in that the middle section (4) of the carrier body (3) is bonded and screwed to the ski (1).

16. A ski as recited in claim 1 having a ski covering layer and a decorative surface foil, and wherein said carrier body is disposed beneath said ski covering layer and said decorative surface foil.

17. A ski as recited in claim 1 comprising a surface foil separated transversely to the longitudinal direction of the ski, and disposed both in front of and behind the carrier body.

18. A ski as recited in claim 1 wherein said guide elements comprise guide rails.

19. A ski as recited in claim 1 wherein said guide elements comprise guide grooves.

* * * * *